US007222850B2

(12) United States Patent
Dobrindt

(10) Patent No.: US 7,222,850 B2
(45) Date of Patent: May 29, 2007

(54) TRANSPORTING AN ESSENTIALLY SHEET-LIKE ELEMENT, PARTICULARLY IN A PRINTING PRESS

(75) Inventor: Dirk Dobrindt, Klausdorf/Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 367 days.

(21) Appl. No.: 10/790,426

(22) Filed: Mar. 1, 2004

(65) Prior Publication Data

US 2004/0245718 A1 Dec. 9, 2004

(30) Foreign Application Priority Data

Mar. 3, 2003 (DE) ..... 103 09 096

(51) Int. Cl.
*B65H 29/00* (2006.01)

(52) U.S. Cl. ..... 271/315; 271/187

(58) Field of Classification Search ..... 271/315, 271/187; 270/52.27

See application file for complete search history.

(56) References Cited

U.S. PATENT DOCUMENTS 1,363,030 A 12/1920 Wise et al.
3,355,169 A 11/1967 Seyl ..... 271/71
4,120,491 A 10/1978 Lang
4,431,178 A 2/1984 Kokubo et al.
4,491,311 A * 1/1985 Glanzmann ..... 270/52.27
5,261,655 A * 11/1993 Keller et al. ..... 271/187
5,409,201 A * 4/1995 Kramer ..... 270/58.13
5,476,256 A * 12/1995 Fortuna et al. ..... 271/187
6,877,740 B2 * 4/2005 Michler et al. ..... 271/187

* cited by examiner

*Primary Examiner*—Patrick Mackey
*Assistant Examiner*—Kaitlin Joerger
(74) *Attorney, Agent, or Firm*—Lawrence P. Kessler

(57) ABSTRACT

Transporting an essentially sheet-like element, particularly for transporting a sheet of printing material in a printing press, in which the sheet-like element is picked up in the area of its leading edge by at least one rotating transport at a pickup site, transported to a delivery site, and then delivered there, wherein the sheet-like element is curved over a rotational or curvature radius during transport. The sheet-like element is forced between the pickup site and the delivery site by at least one guide element, that is, an intermediate guide element, that blocks at least in the centrifugal direction, in order to maintain the radius of curvature.

12 Claims, 3 Drawing Sheets

TRANSPORTING AN ESSENTIALLY SHEET-LIKE ELEMENT, PARTICULARLY IN A PRINTING PRESS

CROSS-REFERENCE TO RELATED APPLICATIONS

Reference is made to the following commonly assigned applications, the disclosure of which is incorporated herein by reference:

U.S. patent application Ser. No. 10/790,155, filed on Mar. 1, 2004, by Dobrindt, entitled, "APPARATUS FOR TRANSPORTING A SHEET-LIKE ELEMENT";

U.S. patent application Ser. No. 10/790,425, filed on Mar. 1, 2004, (now U.S. Pat. No. 7,017,900, issued on Mar. 28, 2006) by Dobrindt, entitled, "TRANSPORTING AN ESSENTIALLY SHEET-SHAPED ELEMENT, PARTICULARLY A PRINT MATERIAL SHEET";

U.S. patent application Ser. No. 10/789,009, filed on Mar. 1, 2004, by Goldbeck, entitled, "CONVEYING AN ESSENTIALLY SHEET-SHAPED ELEMENT, IN PARTICULAR, A SHEET OF PRINTING MEDIUM"; and U.S. patent application Ser. No. 10/790,564, filed on Mar. 1, 2004, by Dobrindt, entitled, "CONVEYING AN ESSENTIALLY SHEET-SHAPED ELEMENT, IN PARTICULAR, A SHEET OF PRINTING MEDIUM".

FIELD OF THE INVENTION

The invention relates to transporting an essentially sheet-like element, particularly for transporting a sheet of printing material in a printing press, preferably in a printing press to be operated electrophotographically. The sheet-like element is picked up in the area of its leading edge by at least one rotating transport at a pickup site, the rotating transport means having, for receiving and entraining the sheet-like element, at least one gripper-like pickup into which the leading edge of the sheet-like element is introduced or inserted, and including at least one fragmentally existing bending core used for curving the sheet-like element during the transport over a rotational or curvature radius, transported to a delivery site, and then delivered there, wherein the sheet-like element is curved over a rotational or curvature radius during transport.

BACKGROUND OF THE INVENTION

A well-known sheet-like element transport apparatus is known, for example, from U.S. Pat. No. 5,261,655. The apparatus therein includes, in particular, a rotating transport with two gripper-like pickups, namely, slots into which the leading edge of a sheet can be fed, at any one time, by infeed rollers in the area of a pickup site. Additionally, separate knurled rollers are arranged in the area of the pickup site that knurl and reinforce the sheets in the lateral direction, particularly their tail ends, in order to ensure a controlled transport movement of the sheet up into this tail area. The knurled rollers in the area of the pickup site are arranged in such a way that they do not impede the feeding by the infeed rollers, not even when the radius of the transport is changed. The knurled rollers also have a radial distance from the rotational axis of the transport that is larger than the minimal radius and smaller than the maximum radius of the transport.

A printing press, particularly a printing press operating electrophotographically, should be able to print the most diverse printing materials, particularly paper having different sheet lengths and paper weights. If an especially heavy-weight paper is to be used, it is necessary, due to the stiffness of the paper, to curve this paper over a large curvature radius, in order to prevent permanent damage to the paper. At the same time, however, it is difficult to curve heavy paper over a large radius. The larger radius, however, also automatically effects a larger curvature circumference or path; that is, a larger path between the pickup and delivery sites. Thus, papers that are both short and heavy are especially difficult to handle. For example, for a paper weight of 300 grams per square meter, it is necessary to provide a minimum curvature radius of 90 mm. This necessarily leads, however, to a curvature length that is at least equal to the length of a DIN A4 sheet. Landscape or smaller formats can therefore flatten the curve over a wide area of the transport path due to their stiffness, thus impairing or endangering the transport as a whole. In order to solve this problem, it is not enough to assist the threading of the sheet in the area of the gripping roller by the knurled rollers, as recommended in the above-mentioned patent.

SUMMARY OF THE INVENTION

The invention therefore has the task of providing sheet-like element transport suitable for the most diverse sheets or sheet-like elements. This task is accomplished according to the invention by forcing the sheet-like element between the pickup site and the delivery site by at least one guide element, that is, an intermediate guide element. The guide element blocks at least in the centrifugal direction, in order to maintain the radius of curvature, wherein, preferably the length and/or width of the sheet-like element are accommodated between the guide element and the delivery site by varying the distance preferably measured across the curvature path of the sheet-like element. As such, the distance, preferably measured across the curvature path of the sheet-like element, is variably adjustable between the guide element and the delivery site to accommodate the length and/or width of the sheet-like element.

The preferred transport has a body with an essentially circular periphery. However, the body could, for example, also be S-shaped or be some other spoke-like shape and fragmentally shallow out into circular arcs. The gripper-like pickup could basically be the form of a slot or a slit or, for example, also as a bay. It is preferable to provide several such pickups that are evenly distributed; two or four pickups are preferred.

The preferred intermediate guide element includes a roller element that is allocated a guide rail. By this means, the sheet-like element is given the required curvature without curving or rippling the element laterally. The guide rail can be a surface of the body of the transport itself, or the surface of another body that it coaxially rotates with, the latter having the benefit of being an additional support and holder for the sheet-like element. If this additional body is somewhat larger than the body of the transport and if the radius of the guide rail is preferably somewhat smaller than the radial distance of the radially exterior inner surface of the gripper-like pickup, then this prevents, on the one hand, the leading edge of the sheet-like element from moving too far into the pickup area and being damaged there and, on the other hand, prevents the sheet-like element from being too twisted by the intermediate guide.

A preferred embodiment of the invention provides for varying the distance of the guide element by a lever arm that is essentially perpendicular, and thus pivotally mounted, and essentially horizontal. In particular, a shifting of the guide element is also possible during operation. The shifting of the guide element is preferably motor-driven. A radial flexibility that is effected by lifting the guide element can also be advantageously permitted, so that possible non-uniformities in the effective diameter of the transport can be adjusted.

The sheet-like element can be ejected from the pickup at the delivery site both simply and automatically. A fixed stop is arranged at the delivery site, opposite from the transport, for the leading edge of the sheet-like element that is inserted into the pickup.

Another improvement of the apparatus according to the invention provides a protective covering for a stack of deposited sheet-like elements, which is located in the area of the delivery site, opposite the transport. This particularly enables the transport to run continually without damaging the deposited stack. A particularly well-controlled handling of the sheet-like element over the lateral width is enabled by preferably providing several coaxial transports spaced apart from one another, with two transport means being preferably arranged laterally reversed with regard to a mirror surface perpendicular to the rotational axis.

BRIEF DESCRIPTION OF THE DRAWINGS

An embodiment from which additional features according to the invention can be derived, but to which the scope of the invention is not limited, is shown in the drawing. In the schematic drawings.

DETAILED DESCRIPTION OF THE INVENTION

Figure 1:
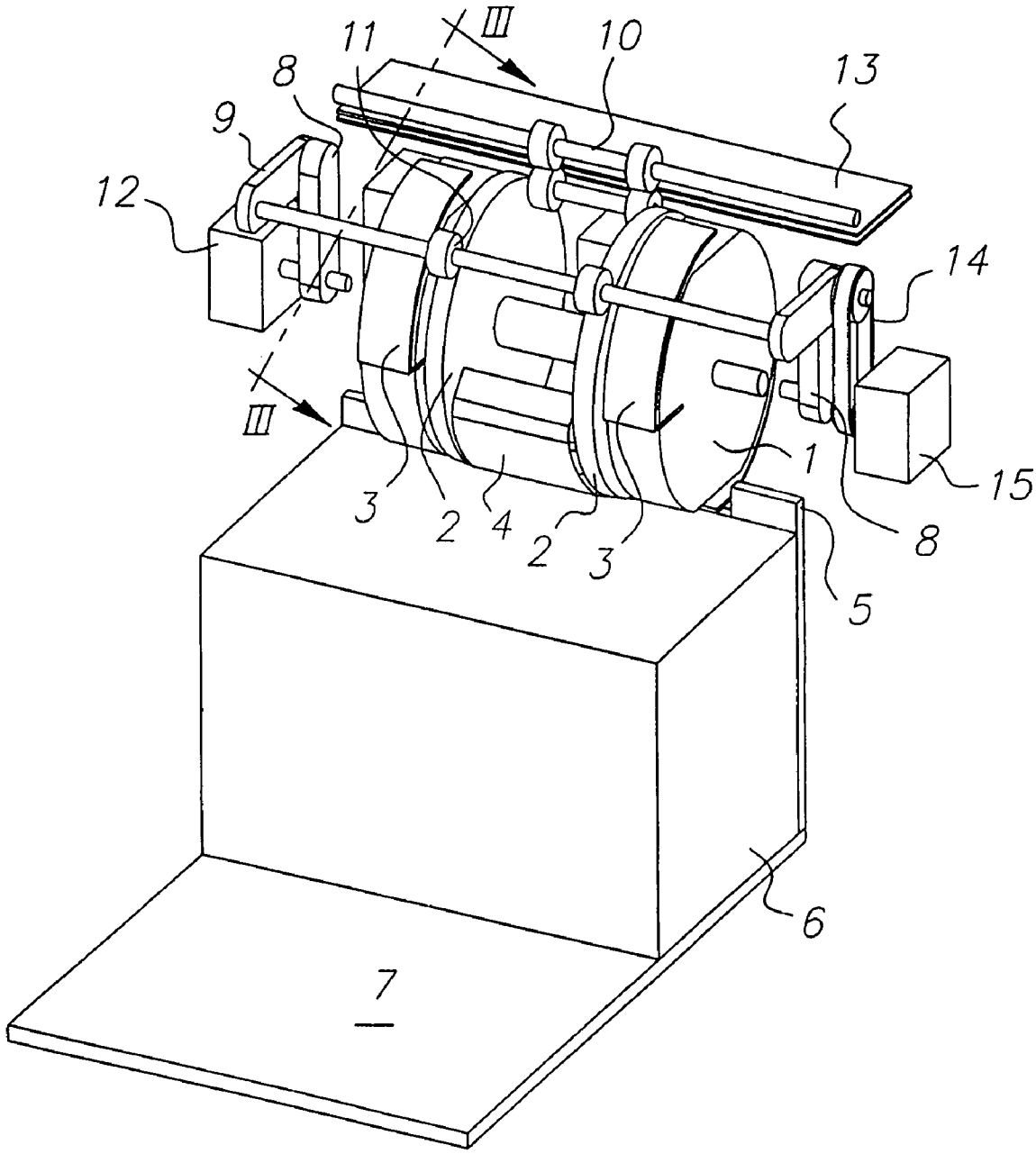
FIG. 1 is a perspective view of an apparatus according to the invention, largely from above.
Figure 3:
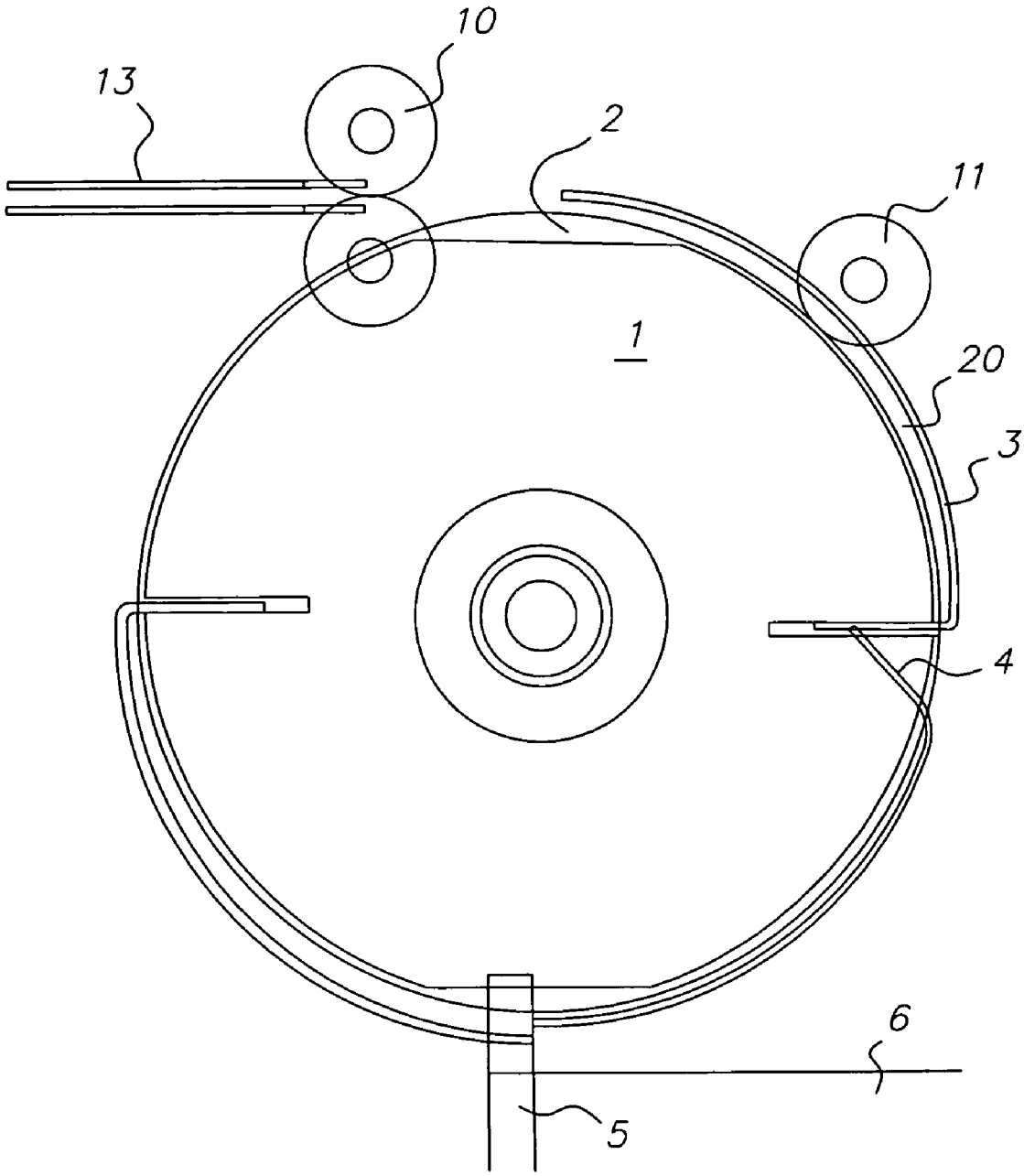
FIG. 3 is a profile view of the apparatus according to FIG. 1 along the dotted line (marked III in FIG. 1) in the direction of the arrow pointing toward the side view of the surrounding field of a transport.

FIG. 1 shows a perspective view of an apparatus according to the invention largely from above. The apparatus according to the invention has a transport that includes two stacking wheels 1 for transporting sheets, namely, for picking up and redirecting the sheets and for delivering the sheets to a stack 6 of sheets on a stacking tray 7. The functional principle of the apparatus can be explained most simply by referring to FIG. 3, which shows one of the stacking wheels 1, along with its surrounding field, in a side view. The apparatus can thus be seen as a profile of the apparatus viewed along the dotted line that is marked with the numeral III in FIG. 1.

Sheets that are to be transported are fed successively to the stacking wheel 1 through paper-guides 13, preferably from the printing area of a printing press. The leading edge of a sheet, that is to be redirected is pushed by a pair of sheet rollers 10 deep into a gripper-like pickup of the stacking wheel 1, which is configured as a slot 20. The outer wall of the slot 20 is formed by a guide 3, which, folded, is attached to the stacking wheel 1. The leading edge of the grasped sheet is adequately secured in the slot 20 while the stacking wheel 1 is rotated around its shaft. Following a half rotation of the stacking wheel 1, that is, after a 180° turn, the leading edge of the sheet reaches a stack edge 5, stops there, clears the slot 20 of the further rotating stacking wheel 1, and falls on stack 6, where it remains deposited. The stacking wheel 1 rotates through the correspondingly interrupted stack edge 5. So that the rotating stacking wheel 1 does not damage the sheet deposited on the top of stack 6, the working area of the stacking wheel 1 is protected with a protective guide 4, which is attached to the stack edge 5. The stacking wheel 1 preferably rotates continuously, rather than in fixed cycles, though not necessarily smoothly. It can, for example, run more slowly when picking up and depositing a sheet than it does during the actual transport of the sheet. Since the stacking wheel 1 has two diametrically opposing slots 20 and since, in this respect, they are configured centro-symmetrical to their rotation shaft, a pickup of the next sheet can occur simultaneously above in the area of the sheet rollers 10, while a transported sheet is being deposited in the area of the stack edge 5.

Additionally, in order to be able to transport shorter and/or heavier sheets, especially sheets of paper, safely and in a controlled fashion, the apparatus includes, in addition to the stacking wheel 1, a guide roll 2. The guide roll 2 is arranged coaxially to the stacking wheel 1 and rotates with it. A pressure roller 11, arranged on a static frame of the apparatus or something similar, unwinds on the guide roll 2 and, as an intermediate guide element between the sheet rollers 10 and the stack edge 5, guides the sheet picked up in slot 20 and pushes it onto the curvature of the stacking wheel 1 or the guide roll 2. In principle, such a pressure roller could unwind by itself onto the stacking wheel 1, but additional space is gained for the pressure roller 11, which can be changed in its intermediate position, by the additional guide roll 2. This guide roll 2 also provides an additional depository for the sheet. In this case, the stacking wheel 1, as well as the guide roll 2, need not be complete wheels. As visible in FIG. 3, the guide roll 2 also has a somewhat larger radius than the inside of the slot 20, but a somewhat smaller radius than the one formed by the exterior of guide tray 3. This means that the loading and unloading of a sheet into or out of the slot 20 is unimpeded, although the sheet is prevented from penetrating too far into the slot and is held securely.

In order to explain the adjustability of the pressure roller 11, or, more precisely, the pressure rollers 11, and the remaining functions of the apparatus, reference is again made to FIG. 1.

First of all, it can be seen in FIG. 1 that stacking wheels 1 and guide rolls 2, pressure rollers 11, and also other elements of the apparatus exist in pairs, in that the apparatus essentially has a mirror-symmetrical design. In FIG. 1, the arrangement of the guide plate 4 for protecting the stack 6 can also be seen.

The pivotal, adjustable arrangement of the pressure rollers 11 is also easily visible in FIG. 1. The position of the pressure rollers 11 can be adjusted to the size of the guide rolls 2. Depending upon the format of the sheet-like element that is to be handled, the pair of pressure rollers 11 is lowered farther or nearer in the direction of the stack edge 5; and, in fact, it is preferable to push it so far that the distance along the curving arc, between the pressure rollers 11 and the stack edge 5, is slightly less than the length of the sheet-like element. When the leading edge of the sheet-like element taps the stack edge, its end is transported out of the pressure area of the pressure rollers 11 by the coaxially rotating guide rolls 2 and the stacking wheels 1 and is thus released for deposit on the stack 6. The sheet-like element is then led safely to the stack edge 5 and not twisted too much before completely exiting the action of the pressure rollers.

The pair of pressure rollers 11 has a rotating-swiveling arrangement. Thus, the pressure rollers can lift off even during the conveyance operation of the guide rolls 2. Provided for this purpose are horizontal lever arms 9, which act upon an axis for the pressure rollers 11 and are operated by a drive 15 via a synchronous belt drive 14. In addition to this, vertical lever arms 8, which are pivotally connected to the horizontal lever arms 9 and driven by a drive 12, are provided for adjusting the pressure rollers 11 along the perimeter of the guide rolls. The drive 15 is beneficially mounted on the horizontal lever arm 9, which ensures that no liftoff movement of the pressure rollers 11 is initiated during the adjustment movement with the drive 12. A liftoff movement of the pressure rollers 11 is required, so that changing effective external diameters of the stacking wheel 1, which can occur due to the path and configuration of the slot 20, do not stress the sheet-like element. The rotational axis of the vertical lever arms 8, are coaxial to the shaft for the stacking wheels 1 and the guide rolls 2.

Since the stacking process itself determines that, when the format of the sheet-like element is changed, the transition can be only from a larger to a smaller format, in this path the pressure rollers 11 sink increasingly lower in the direction of the stack edge 5. The possibility of a counter-rotational movement must therefore not necessarily be provided.

Figure 2:
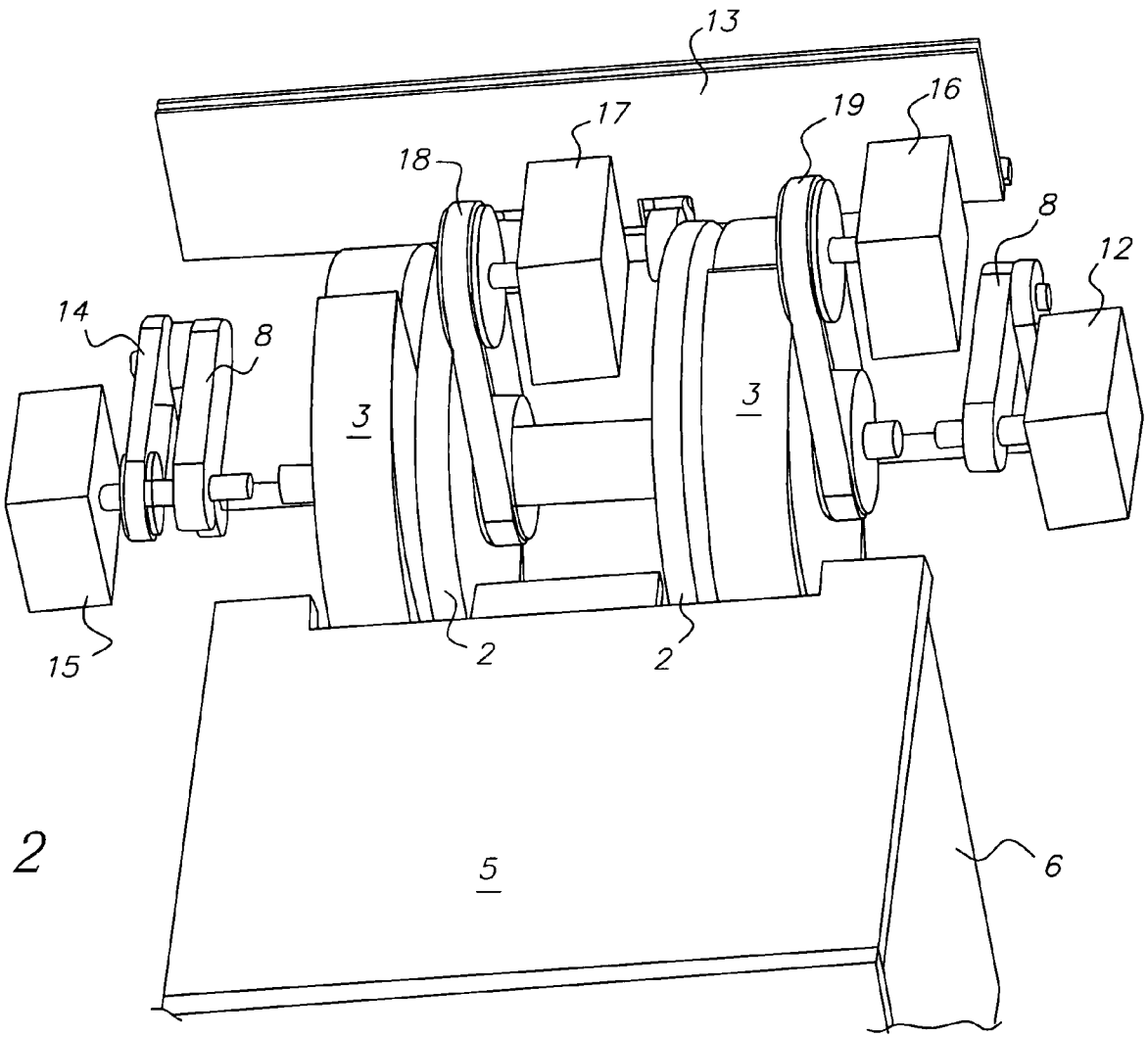
FIG. 2 shows the apparatus according to FIG. 1 in a perspective view, largely from below.

FIG. 2 shows a bottom view of the apparatus according to FIG. 1. The same components are designated with the same reference numbers as in FIG. 1 and FIG. 3. In the view in FIG. 2, the drives 16 and 17 for the stacking wheels 1 and the guide rolls 2, and the belt drives 18 and 19 provided for them, are particularly visible.

The invention has been described in detail with particular reference to certain preferred embodiments thereof, but it will be understood that variations and modifications can be effected within the spirit and scope of the invention.

What is claimed is:

1. Apparatus for transporting a sheet of printing material in a printing press, the apparatus comprising:

at least one rotating transport for transporting the sheet from a pickup site to a delivery site and delivering the sheet there, said rotating transport having, for receiving and entraining the sheet, at least one gripper pickup defined as a slot or a slit into which the leading edge of the sheet is introduced or inserted, and including at least one fragmentally existing bending core used for curving the sheet during the transport over a rotational or curvature radius; and at least one guide element between the pickup site and the delivery site blocks, at least in the centrifugal direction, for the purpose of maintaining the radius of curvature wherein a distance, measured across the curvature path of the sheet, is variably adjustable between the guide element and the delivery site to accommodate the length and/or width of the sheet.

2. Apparatus according to claim 1, wherein said transport includes a body with an essentially circular periphery.

3. Apparatus according to claim 2, wherein a majority of gripper pickups are arranged in an even distribution over a 360° angle.

4. Apparatus according to claim 2, wherein said guide element comprises a roller element for which an essentially circular guide rail is provided as a guide, said guide rail being identical, with or coaxially offset to, the circular periphery of the body of said transport and arranged to rotate with the body.

5. Apparatus according to claim 4, wherein said guide rail that is coaxially offset to the body of said transport has a somewhat larger radius than the body.

6. Apparatus according to claim 5, wherein said radius of the guide rail is somewhat smaller than the radial distance of the radially exterior inner surface of said gripper pickup.

7. Apparatus according to claim 4, further including a lever arm that is essentially perpendicular, and thus pivotally mounted, and essentially horizontal for varying the distance of the guide element.

8. Apparatus according to claim 7, wherein said guide element can be shifted by motor power.

9. Apparatus according to claim 1, further including a fixed stop that is arranged in the area of the delivery site for the leading edge of the sheet-like element that is inserted into said at least one gripper pickup.

10. Apparatus according to claim 1, further including a protective covering for a stack of deposited sheets provided in the area of the delivery site, opposite said transport.

11. Apparatus according to claim 1, further including several coaxial transports spaced apart from one another.

12. Apparatus according to claim 11, wherein two transports are arranged laterally reversed with regard to a mirror surface perpendicular to the rotational axis.

* * * * *